US005867827A

United States Patent [19]

Wilkinson

[11] Patent Number: 5,867,827

[45] **Date of Patent: *Feb. 9, 1999**

[54] ENERGY EXPENDITURE GARMENT

[76] Inventor: William T. Wilkinson, P.O. Box 73, Salem, N.J. 08079

[ * ] Notice: The term of this patent shall not extend beyond the expiration date of Pat. No. 5,737,773.

[21] Appl. No.: 986,521

[22] Filed: Dec. 8, 1997

[51] Int. Cl.[6] ..... A41D 1/00; A41D 13/02

[52] U.S. Cl. ..... 2/69; 2/79; 2/115; 482/105

[58] Field of Search ..... 2/69, 79, 228, 2/238, 170, 108, 115, 102, 70, 227; 482/105, 121, 124, 131, 74; 450/104

[56] References Cited

U.S. PATENT DOCUMENTS

| | | | |
|---|---|---|---|
| 1,178,165 | 8/1916 | Lupton . | |
| 2,097,376 | 10/1937 | Marshman . | |
| 2,613,932 | 10/1952 | Manners . | |
| 3,411,500 | 11/1968 | Gatts . | |
| 3,559,654 | 2/1971 | Pope . | |
| 3,759,510 | 9/1973 | Jackson . | |
| 4,065,814 | 1/1978 | Fox | 2/79 |
| 4,220,299 | 9/1980 | Motter . | |
| 4,325,379 | 4/1982 | Ozbey . | |
| 4,384,369 | 5/1983 | Prince . | |
| 4,570,268 | 2/1986 | Freeman | 2/114 |
| 4,670,913 | 6/1987 | Morell et al. | 2/227 |
| 4,698,847 | 10/1987 | Yoshihara . | |
| 4,910,802 | 3/1990 | Malloy . | |
| 4,953,856 | 9/1990 | Fox . | |
| 4,961,573 | 10/1990 | Wehrell . | |
| 4,968,028 | 11/1990 | Wehrell . | |
| 4,993,705 | 2/1991 | Tolle . | |
| 5,033,123 | 7/1991 | Audet . | |
| 5,046,194 | 9/1991 | Alaniz . | |
| 5,060,315 | 10/1991 | Ewing . | |
| 5,062,642 | 11/1991 | Berry . | |
| 5,109,546 | 5/1992 | Dicker . | |
| 5,141,223 | 8/1992 | Block . | |
| 5,176,600 | 1/1993 | Wilkinson . | |
| 5,186,701 | 2/1993 | Wilkinson . | |
| 5,201,074 | 4/1993 | Dicker . | |
| 5,203,754 | 4/1993 | Maclean . | |
| 5,256,119 | 10/1993 | Tudor . | |
| 5,263,916 | 11/1993 | Bobich . | |
| 5,267,928 | 12/1993 | Barile . | |
| 5,282,277 | 2/1994 | Onozawa . | |
| 5,306,222 | 4/1994 | Wilkinson . | |
| 5,308,305 | 5/1994 | Romney . | |
| 5,336,139 | 8/1994 | Miller . | |
| 5,357,637 | 10/1994 | Moore . | |
| 5,367,708 | 11/1994 | Fujimoto . | |
| 5,372,565 | 12/1994 | Burdenko . | |
| 5,375,610 | 12/1994 | LaCourse . | |
| 5,383,235 | 1/1995 | Peters . | |
| 5,465,428 | 11/1995 | Earl . | |
| 5,518,480 | 5/1996 | Frappier . | |
| 5,518,481 | 5/1996 | Darkwah . | |
| 5,570,472 | 11/1996 | Dicker . | |
| 5,708,976 | 1/1998 | Dicker | 2/69 |
| 5,737,772 | 4/1998 | Dicker et al. | 2/69 |
| 5,737,773 | 4/1998 | Dicker et al. | 2/69 |
| 5,745,917 | 5/1998 | Dicker et al. | 2/69 |
| 5,778,452 | 7/1998 | Dicker et al. | 2/69 |

*Primary Examiner*—Gloria M. Hale
*Attorney, Agent, or Firm*—Connolly & Hutz

[57] ABSTRACT

An energy expenditure garment is in the form of a one piece suit having a neck opening at its top and leg openings at the bottom of its torso section. Size adjusting structure is provided at the neck opening to permit the neck opening to be enlarged from its first wearing size to an enlarged passage size sufficiently large so that the garment may be placed on the user by the user inserting the user's legs, hips and body through the enlarged neck opening.

22 Claims, 1 Drawing Sheet

24
18
20
26
22
12
28
28
10
16
14
30

24
32

34
36

24
32

40
42
42
38

19
24
37
20
22

40
42

ENERGY EXPENDITURE GARMENT

BACKGROUND OF THE INVENTION

Various garments have been suggested which involve elastic elements to provide a resistance to an activity which would require the swinging or bending of the arms and/or legs and/or body. Generally, such elastic elements are elastic cords or bands which are separate from the remainder of the garment, but are otherwise attached to the garment or the elastic elements are in the form of elastic panels which are integral with the remainder of the garment. Examples of such garments described in patents are found in U.S. Pat. Nos. 5,109,546, 5,176,600, 5,186,701, 5,201,074, 5,306,222 and 5,570,472. Additional disclosures of such garments are found in various U.S. patent applications, namely, Ser. No. 627,426, filed Apr. 4, 1996, Ser. No. 660,098, filed Jun. 6, 1996, Ser. No. 734,736, filed Oct. 21, 1996, Ser. No. 761,290, filed Dec. 6, 1996, Ser. No. 777,453, filed Dec. 3, 1996, Ser. No. 802,972, filed Feb. 20, 1997, Ser. No. 802,973, filed Feb. 20, 1997, Ser. No. 834,887, filed Apr. 7, 1997, Ser. No. 840,917, filed Apr. 25, 1997, Ser. No. 880,715, filed Jun. 23, 1997, and Ser. No. 892,669, filed Jul. 14, 1997.

SUMMARY OF THE INVENTION

An object of this invention is to provide an energy expenditure garment particularly of the one piece type which is worn by the user fitting the user's body through a neck opening.

A further object of this invention is to provide an energy expenditure garment intended to have a tight fitting neck opening which is adjustable in its size to permit the user's body to readily slip through the neck opening.

In accordance with this invention an energy expenditure garment is formed from a base material with a plurality of longitudinal elastic resistance elements secured to the base material. The elastic resistance elements are made of a material requiring a greater force to stretch the resistance elements and resist the elements from returning from to their original conditions than would be the force required for the base fabric or material. The garment is a one piece suit having a torso section with the neck opening at its top and the leg openings at the bottom of the torso section. The neck opening functions as the body insertion passage in the sense that the garment is placed on the user by the user inserting the legs and then body through the neck opening. Size adjusting structure is provided at the neck opening and extends outwardly from the neck opening to selectively adjust the size to a first wearing size which fits snugly around the neck and to a second enlarged passage size to be sufficiently large so that the user's legs and body can readily pass through the enlarged size neck opening and then the neck opening can be returned to its first wearing size during periods of wearing and use of the garment.

In one practice of the invention the size adjusting structure includes a slit extending outwardly from the neck opening with fastening elements on each side of the slit to readily open or close the slit. In another practice of the invention the neck opening includes a panel which is selectively covered by a flap. When the flap is in the closed condition the panel is covered and the neck opening is in its first size. When the flap is opened the panel is exposed and the neck opening is enlarged.

THE DRAWINGS

DETAILED DESCRIPTION

The present invention is directed to energy expenditure garments of the type shown in the above noted patents and applications. All of the details of those patents and applications are incorporated herein by reference thereto. Such energy expenditure garments include elongated elastic resistance elements providing greater resistance force than the base fabric of the garment. In some garments the elastic resistance elements are located near the neck portion of the garment. In such cases the neck portion sometimes functions as part of the anchoring structure for the elastic resistance elements. Where the garment is made of a separate shirt open at the bottom and a separate pants there is generally no difficulty in the user putting on the garment by simply inserting the user's legs through the open top of the pants and inserting the user's arms and body through the open bottom of the shirt. Difficulties arise, however, where the garment is of one piece construction such as by having an integral pants and shirt section or by the garment being in the form of leotards. With such one piece construction it is necessary to place the garment on the user by the user first inserting the legs and then the hips and then the remainder of the body through the neck opening. If the neck opening is made overly large in order to facilitate the user putting on or removing garment, a number of disadvantages would result. For example, an overly large opening would reduce the effectiveness of the resistance elements. An overly large opening would also expose more skin which could cause the garment to be uncomfortable by the user being cold. An overly large opening also compromises the resistance/tension characteristics of the garment. Because the resistance elements tend to resist any stretching, it is difficult to stretch the garment starting from the neck opening in opposition to the resistance force being applied by the elongated elements.

The present invention overcomes these disadvantages by providing size adjusting structures at the neck opening. As a result, it is possible to use a relatively small neck opening which fits snugly on the user's neck during use of the garment. The size adjusting structure, however, permits the user to selectively enlarge the size of the opening when it is desired to remove the garment or put the garment on so that the user's body, including legs, hips, etc. can readily fit through the neck opening with little or no stretching of the neck opening.

Figure 1:
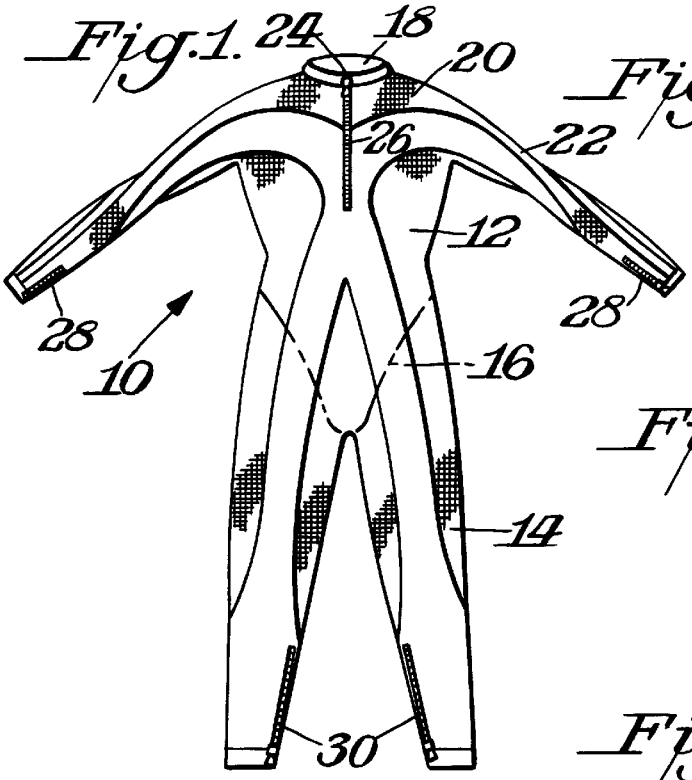
FIG. 1 is an elevational view of an aerobic resistance garment in accordance with this invention.

FIG. 1 illustrates an aerobic resistance garment 10 in accordance with this invention. The illustrated garment is made of one piece construction which requires the user to remove or to place the garment on by use of the neck opening. FIG. 1 illustrates in solid lines the garment 10 to include a torso section 12 having integral pants 14 with downwardly extending legs where the suit thus includes an upper body portion and pants portion integral with each other whereby the leg openings are in the pants portion. FIG. 1 also shows in phantom the one piece garment to be in the form of leotards 16 simply having leg openings without any actual downwardly extending legs.

The garment 10 also includes a neck opening 18. The material forming the neck opening may be of base fabric as later described or may be a compression collar particularly where the neck opening is an anchor location.

Garment 10 is made of a base fabric or base material 20 to which the suitably located and number of resistance elements 22 are secured. Resistance elements 22 are preferably in the form of bands. Any suitable number and location of elastic resistance bands or elements may be used as disclosed in the above noted patents and applications. Generally, such elastic resistance elements are anchored at their free ends in order to enhance the resistance offered when the user stretches the resistance elements.

FIG. 1 illustrates a slit 24 formed in the resistance garment extending downwardly from the neck opening 18. Fastening structure is applied to each side of the slit for selectively closing the slit or permitting the slit to open. FIG. 1 illustrates the preferred practice of the invention wherein the fastening structure is a zipper 26. If desired, fastening members 28,30 may be applied to the ends of the arms and legs for facilitating the insertion of the arms and legs through the sleeves and leg portions of the suit and then closing the fastening elements to snugly fit those portions against the user. Preferably the slit and fastening members extend through wrist/ankle compression cuffs.

The length of slit 24 should be such that it is long enough to expand or enlarge the size of the neck opening to readily permit the user's legs, hips and torso to be inserted through the neck opening when placing the garment on for later removal. In particular it should be large enough to permit passage of the hips which generally is the widest portion of the user's body. The length could be customized for particular users or sets of users. Thus, for example, a garment intended for children could have a smaller length than one intended for adults. Generally, the length should be at least three inches long particularly if more than one slit is provided. Where a single slit is provided the length should be at least four inches long from the base of the neck where the neck opening is generally disposed at the Adam's apple.

In the embodiment shown in FIG. 1 the slit and zipper are about 10 inches long and neck opening 18 has a diameter of about 4½ inches in its closed or wearing size. The diameter could be between 4 inches and 5 inches. As noted the slit is preferably at least 4 inches long but could be at least 6 or 8 or 10 inches long. The neck opening in its open or body passage size would form a generally oval shape and have a large diameter of about 42 inches to permit use by wearers having a hip size of 42 inches. If desired the open size could be smaller, such as at least 30 inches or 36 inches even if some slight stretching of the neck opening is necessary for putting on the garment.

FIG. 1 illustrates the preferred location for the size adjusting structure centrally located at the front of the body extending downwardly from the neck opening. Since the neck opening is intended to preferably fit snugly around the neck the opening is of a smooth uniform arc such as a circle or oval in the closed or wearing condition.

Figure 2:
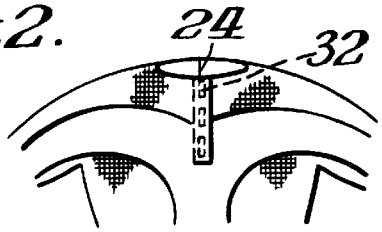
FIG. 2 is a front elevational view of a portion of the garment of FIG. 1 with alternative fastening structure.

FIG. 2 illustrates a variation of the invention wherein VELCRO or hook and loop fasteners 32 are provided to close the slit. FIG. 2 also illustrates a second slit 24 to be located at the back of the garment.

Figure 3:
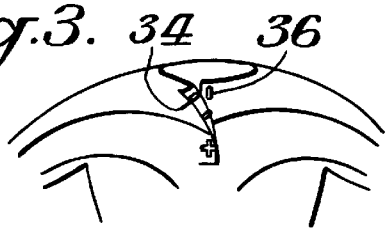
FIG. 3 is a view similar to FIG. 2 showing yet further fastening structure.

FIG. 3 shows a variation of the invention wherein holes or loops 34 are provided on one side of the slit for engagement with hooks or studs 36 on the other side of the slit. Similarly, buttons and holes may be used.

Figure 4:
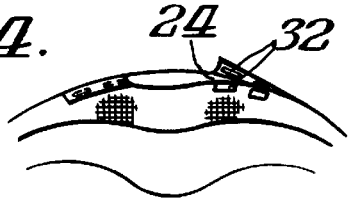
FIG. 4 is a view similar to FIGS. 2–3 showing the fastening structure at a different location.

FIG. 4 shows a variation wherein the slits 24 with the corresponding fasteners 32 extend along each shoulder at the neck opening.

Figure 5:
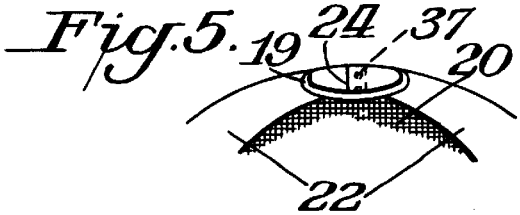
FIG. 5 is a view similar to FIG. 2 showing fastening structure at the back of the garment and a variation in structure at the neck opening.

FIG. 5 shows the slit 24 to be located solely at the back of the garment with snap fasteners 37. FIG. 5 also shows the neck opening to include a compression collar 19 which anchors the resistance elements 22.

Figure 6:
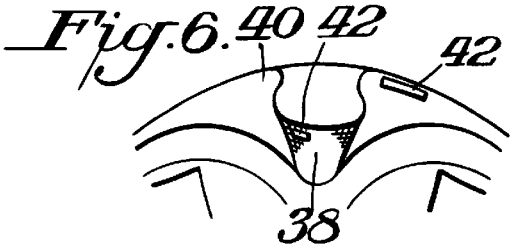
FIG. 6 is a view similar to FIGS. 2–5 showing a modified form of size adjustment in the open condition.
Figure 7:
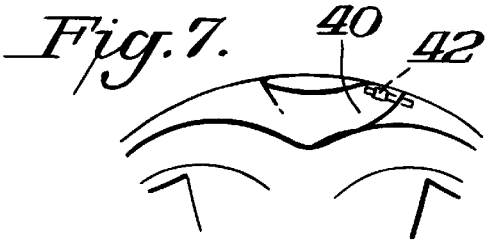
FIG. 7 is a view similar to FIG. 6 showing the neck in the closed position.

FIGS. 6–7 show a variation of the invention wherein the size adjustment does not involve an actual cutting or slitting of the garment. Instead, a panel 38 is provided at one or more locations extending from the neck opening. The garment itself includes material 40 adjacent to or part of the panel which would function as a flap to fold over the panel thus closing the opening. FIG. 6, for example, illustrates hook and loop fasteners 42 on the flap 40 and on the shoulder of the garment. FIG. 6 shows the neck opening 18 in its enlarged condition, while FIG. 7 shows the fasteners 42 engaged with each other to reduce the size of neck opening 18 to its wearing size.

The dimensioning for the neck opening and panel length would be comparable to the variations using a slit.

It is to be understood that the various types of fasteners may be used for closing the slit or covering the panel in the size adjustment of the neck opening.

The present invention thus provides a neck opening of a one piece energy expenditure garment to include size adjusting structure so that the neck opening could be selectively adjusted in its size to a first wearing size of circular or oval form for fitting snugly around the neck. The size adjusting structure permits the neck opening to be increased to a second enlarged passage size to be sufficiently large for permitting the user's legs, hips and body to pass through. Once the garment is placed on the user the size adjusting structure would then return the neck opening to its first wearing size. The size adjusting structure could be in the form of a slit with fasteners for selectively closing the slit or a panel and flap with fasteners for selectively covering and uncovering the panel. The fasteners in the various practices of the invention function additionally to pull the garment together at the neck thereby enhancing the effectiveness of the energy expenditure garment. The invention is particularly useful in garments having one or more resistance bands extending transversely in the general area of the neck (e.g. the chest and/or shoulders) which would otherwise make it difficult to stretch the neck opening sufficiently large for passage of the body. The invention accordingly addresses and solves the problem of having a sufficiently small neck opening with its attendant advantages yet avoiding the difficulties in putting the garment on or taking the garment off while still maintaining the best appearance for the garment and minimizing skin exposure.

What is claimed is:

1. An energy expenditure garment comprising a one piece suit having a torso section with a neck opening at the top of said torso section and having leg openings at the bottom of said torso section, said neck opening comprising a body insertion passage whereby said suit is placed on the body of a wearer by the wearer first inserting the legs of the wearer and then the hips of the wearer and then the body of the wearer through said neck opening, said torso section being made of a base fabric, a plurality of elongated resistance elements connected to said base fabric, said elongated resistance elements being made of a material which requires a greater force than the material of said base fabric to stretch said elongated resistance elements and to resist said resistance elements returning to their unstretched condition, said elongated resistance elements being on said torso section at locations which offer resistance to the stretching of said neck opening to a larger size, and size adjusting structure at said neck opening extending outwardly from said neck opening to selectively adjust the size of said neck opening to a first wearing size of circular or oval shape for fitting snugly around the neck of the wearer and to a second enlarged passage size to be sufficiently large to permit the wearer's legs and hips and body to pass through said enlarged size neck opening and then to return said neck opening to said first wearing size during periods of wearing use of said garment.

2. The garment of claim 1 wherein said size adjusting structure includes a slit extending outwardly from said neck opening and fasteners on each side of said slit.

3. The garment of claim 2 wherein a plurality of slits and fasteners are provided at said neck opening, and said plurality of said slits being at least three inches long.

4. The garment of claim 2 wherein said slit is at least four inches long.

5. The garment of claim 2 wherein said slit is at least eight inches long.

6. The garment of claim 2 wherein said fasteners comprise hook and loop fasteners.

7. The garment of claim 2 wherein said fasteners comprise a zipper.

8. The garment of claim 2 wherein said slit extends downwardly centrally located on the front of said garment.

9. The garment of claim 2 wherein said slit is located from said neck opening and extends along a shoulder of said garment.

10. The garment of claim 1 wherein said garment is a one piece body suit having downwardly extending legs and outwardly extending arms.

11. The garment of claim 10 wherein each of said arms and each of said legs includes slits and fasteners.

12. The garment of claim 11 wherein said arms terminate in compressive wrist cuffs and said legs terminate in compressive ankle cuffs.

13. The garment of claim 1 wherein said garment is a one piece leotard.

14. The garment of claim 1 wherein said elastic resistance elements extends to said neck opening, and said neck opening being a compressive collar.

15. The garment of claim 14 wherein said elastic resistance elements extend down arm portions of said body section along the front and back of said arm portions.

16. The garment of claim 15 including slits and fasteners at the ends of said arms.

17. The garment of claim 16 wherein said garment is a body suit having a pants portion with downwardly extending legs, and said elastic resistance elements also being located on said legs.

18. The garment of claim 1 wherein said size adjusting structure includes a panel extending downwardly from said neck opening, a flap integral with said panel for selectively covering and uncovering said panel, and fasteners for permitting said flap to cover said panel and maintain said neck opening in its said first wearing size.

19. The garment of claim 18 wherein said panel and said flap extend downwardly on the front of said garment.

20. The garment of claim 19 wherein said fasteners are located on said flap and on a portion of said torso section separate from said panel.

21. The garment of claim 1 wherein said elastic resistance elements extend transversely on said torso section generally located near said neck opening.

22. The method of wearing an energy expenditure garment as claimed in claim 1 including the steps of manipulating size adjusting structure on the neck opening to enlarge the neck opening to a size sufficient for the user to place the garment on the user by the user inserting the user's legs and then hips and then the remaining body portion through the enlarged neck opening, then manipulating the size adjusting structure to reduce the size of the neck opening for snugly fitting around the user's neck, then manipulating the size adjusting structure to again enlarge the size of the neck opening, and then removing the garment by passage of the user through the enlarged neck opening.

* * * * *

UNITED STATES PATENT AND TRADEMARK OFFICE

Certificate

Patent No. 5,867,827 Patented: February 9, 1999

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: William T. Wilkinson and Timothy P. Dicker.

Signed and Sealed this Twenty-First Day of March, 2000.

JOHN J. CALVERT
Supervisory Patent Examiner,
Art Unit 3741